United States Patent [19]

Franke

[11] 4,156,405

[45] May 29, 1979

[54] INTERNAL COMBUSTION ENGINE INSTALLATION

[76] Inventor: Walter Franke, Hittfelder Kirchweg 22, 2105 Seevetal 3, Fed. Rep. of Germany

[21] Appl. No.: 838,397

[22] Filed: Sep. 30, 1977

[30] Foreign Application Priority Data

Oct. 5, 1976 [DE] Fed. Rep. of Germany ..... 2644874

[51] Int. Cl.[2] ..... F02B 3/00

[52] U.S. Cl. ..... 123/32 EH; 261/DIG. 19

[58] Field of Search ..... 123/32 EH, 32 EI; 261/DIG. 19

[56] References Cited

U.S. PATENT DOCUMENTS

| | | | |
|---|---|---|---|
| 3,158,144 | 11/1964 | Walker | 261/DIG. 19 |
| 3,374,991 | 3/1968 | Walker | 261/DIG. 19 |
| 3,455,260 | 7/1969 | Mennesson | 261/DIG. 19 |
| 3,727,591 | 4/1973 | Suda | 123/32 EH |
| 3,898,963 | 8/1975 | Iwata et al. | 123/32 EH |
| 4,062,328 | 12/1977 | Konno | 123/32 EL |
| 4,064,844 | 12/1977 | Matsumoto et al. | 123/32 EL |
| 4,075,988 | 2/1978 | Kato | 123/32 EL |

FOREIGN PATENT DOCUMENTS

| | | | |
|---|---|---|---|
| 749897 | 5/1933 | France | 261/DIG. 19 |
| 466164 | 5/1937 | United Kingdom | 261/DIG. 19 |

*Primary Examiner*—Charles J. Myhre
*Assistant Examiner*—R. A. Nelli
*Attorney, Agent, or Firm*—Toren, McGeady and Stanger

[57] ABSTRACT

An internal combustion engine installation with a carburetor of any of various conventional carburetor types having at least one main jet, optionally a slow running jet, as well as a throttle member controlled by an accelerator lever or pedal wherein are provided valve means for interrupting the fuel supply by blocking the one or several carburetor jets in response to a predetermined rotational speed of the engine or a predetermined degree of vacuum in the intake manifold, and optionally a return or release movement of the accelerator lever or pedal to prevent unnecessary fuel consumption and to reduce the amount of pollutants in the exhaust gases.

6 Claims, 2 Drawing Figures

INTERNAL COMBUSTION ENGINE INSTALLATION

Figure 1:
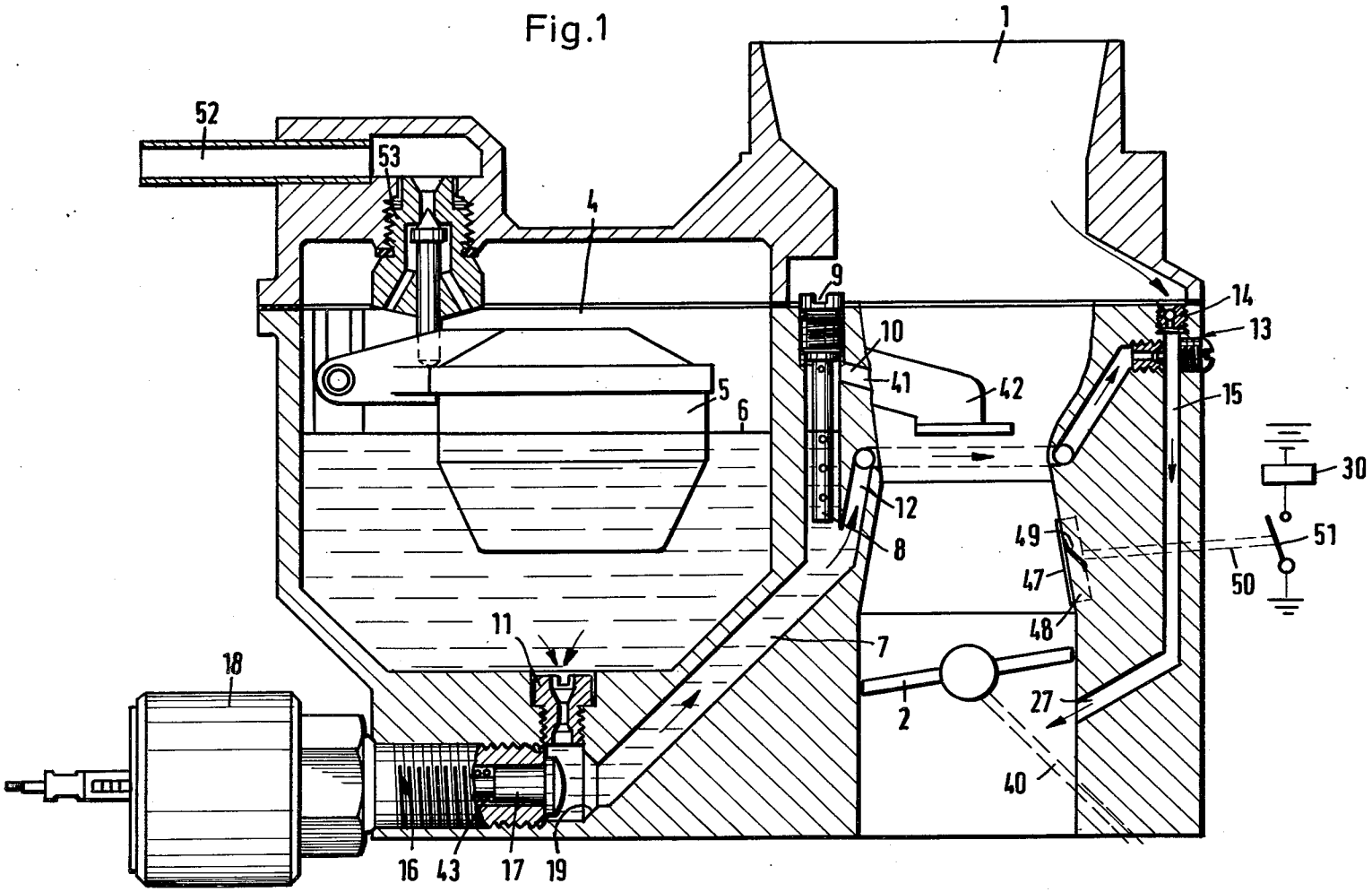

The present invention relates generally to internal combustion engines and more particularly to an internal combustion engine installation with a carburettor having at least one main jet, optionally a slow running jet, and an accelerator lever, particularly in the form of an accelerator pedal, as well as valve means for blocking or admitting fuel flow to a jet in dependence upon the rotational speed of the engine. The present invention particularly relates to an internal combustion engine and the control devices thereof, and for this reason the apparatus of the present invention has been called "installation".

An internal combustion engine installation of the type to which the present specification relates may be mounted in a vehicle whereby the accelerator lever is conventionally a pedal, or a stationary internal combustion engine of this type may be employed for driving a machine of any type. It is known to effect rotational speed measurements either by a tachometer coupled to a rotating shaft or to pick up the rotational speed at the rotating distributor of the ignition device of an internal combustion engine.

There are already known internal combustion engines having either only a carburettor main jet or a main jet and a slow running or idling jet.

The present invention relates to carburettor type engines including any type of carburettor, i.e. brake air jet carburettors, jet needle type carburettors and the like wherein a different type of metering body may be employed instead of a jet needle.

The invention furthermore likewise relates to internal combustion engine installations or respectively internal combustion engines having in their fuel supply system an inflow control chamber or respectively a float chamber or float housing in which may be adjusted a predetermined fuel level for the feed of the carburettor. This constitutes the pre-requisite for an uniform operation under the suction effects at a main jet and a slow running jet. In this context it should be pointed out that it is conventional to arrange for example the float housing generally, and particularly with respect to a vehicle and the longitudinal direction of the vehicle, in a position laterally of the carburettor proper.

In a carburettor having a slow running jet it is already known to block the slow running jet when turning the ignition off. This action is performed by solenoid valves, particularly valves adapted to move a jet needle in the axial direction. This jet needle is resiliently supported and will be released by turning the ignition off so that the spring biases this needle into the jet orifice. In operation the solenoid valve retracts the jet needle into its operational position and holds the needle in this position.

A blockage of this type of the slow running jet during deactivation of the ignition serves to avoid so-called ignition by incandescence upon switching off the engine. By the German Laying-Open specification No. 2,526,398, however, it is likewise known to provide a valve means in the idling system of a carburettor, and to control this valve means in response to vehicle or engine speed so that from a predetermined speed onwards the flow of the combustible mixture is interrupted or reduced. Toward this purpose, there is provided, in the heretofore known arrangement, an automatic control system that is responsive to the vehicle speed or the rotational speed of the engine. For example the slow running fuel passage may be blocked when the engine or the vehicle operates at a speed at which the carburettor main jet has already assumed normal operation. In this arrangement it is likewise known that for a reduction of velocity or rotational speed the automatic control system controls the valve means upstream of the slow running jet again into its conventional operational condition, i.e. into the open position.

In the heretofore known apparatus the slow running jet will come into operation when a substantial increase of vacuum occurs within the distributor manifold below the carburettor throttle valve, i.e. when the throttle valve is closed. It has been found that this condition will occur particularly during periods of operation in which retardation or braking occurs, for example when the engine is being "pushed". In this condition and in combination with the vacuum the above described function of the slow running jet actually supplies combustible mixture at a time at which this mixture is unnecessary and disadvantageous. For this reason the prior art arrangement serves to block the slow running jet or to reduce the fuel supply when the engine is in braking operation. In this manner, there is effected particularly an economy of fuel.

The present invention, in contrast thereto, is based upon the finding that in carburettor engines the pollutants, particularly the proportions of hydrocarbons will increase when the engine is being pushed. This drawback arises from the fact that in pushing operation of the engine when the throttle valve is almost closed or is fully closed there will be generated a vacuum that generally attracts fuel, particularly through the slow running jet, in producing a mixture which is an enriched mixture because the air feed particularly to the slow running jet remains constant. This leads not only to an unnecessary fuel consumption but especially to a deteriorated combustion in pushing operation. For overcoming this drawback, it is known by an article in "Das grosse ADAC-Autobuch" (Car Manual by the biggest German Automobile Club Assocation), 1976, page 53, to provide special means, particularly throttle valve closing attenuators for preventing a too rapid closing of the throttle valve. Thereby sufficient air for an as complete as possible combustion is supposed to be supplied to the cylinder also in pushing operation. This, however, is in opposition to the motor control that triggers pushing operation because the indicated expedients introduce motive pulses.

Although there has been mentioned above a jet needle type of valve means, it is pointed out that such jet needle type arrangements may likewise be employed with the present invention but will serve a different purpose.

It is an object of the present invention to provide a novel and improved internal combustion engine installation.

It is another object of the present invention to provide an improved internal combustion engine installation or respectively a carburettor engine that allows to achieve not only quite safely an economy of fuel but especially also clean exhaust gases.

This object is achieved by the fact that the valve means is arranged in the connecting line intermediate an inflow control chamber or respectively float chamber and the carburettor upstream of the branch-off to an optionally provided slow running jet, and there is provided blocking means for at least the main jet and optionally the main jet and a slow running or auxiliary jet, the blocking means being responsive to the rotational speed or the vacuum in the intake space.

The deactivation of the carburettor and optionally of the main jet is advantageous in preventing the supply of fuel through the main jet under predetermined operational conditions. In vehicle-mounted engine installations to which the present invention very advantageously relates, there will result the drawback that the main jet still supplies fuel even when blocking the slow running jet in dependence upon a certain vehicle speed down to a predetermined rotational speed at which the blockage will again be lifted in combination with the invention. This is caused by several reasons. On the one hand, the throttle valve quite often does not close perfectly so as to interrupt all air flow and to exclude an additional supply of fuel along this path, and on the other hand the so-called inflow control chamber, particularly the float chamber is generally arranged in a lateral position. In dependence upon the tilt of a vehicle in a curve such as the tilt of a two-wheel vehicle, and additionally by the centrifugal forces generated when the vehicle negotiates a curve laterally mounted floats are especially prone to the risk of flooding, in curves of a certain direction, the main jet of the carburettor by exiting fuel, even without any significant air flow. This increases not only the fuel consumption but leads likewise to exhaust gas pollutants. Particularly these last-mentioned effects are avoided by the present invention when blocking, in certain operational conditions, the inflow control chamber or respectively the float chamber against the carburettor itself, and this inclusive of all systems that are optionally provided.

In a particularly preferred embodiment of the invention a contact switch is associated with the accelerator lever, particularly the accelerator pedal, and the contact switch is adapted to be actuated in response to a backwardly directed movement of the accelerator lever to block at least the main jet. This provides a relatively simple solution. In accordance with another embodiment of the present invention, a diaphragm may be mounted at a portion of the cylinder wall or of an intake manifold, and a sensor engages this diaphragm and is adapted to block at least the main jet.

When employing a rotational speed measuring device, this rotational speed measuring device may be associated with a switch means for controlling unblocking of the at least one jet.

In combination with a rotational speed measuring device the switch means of the rotational speed measuring device is preferably adjusted for a rotational speed in the range of from 1,000 to 1,500 r.p.m., and the valve means is open at speeds below the selected speed.

In the following, the present invention will be described more in detail with reference to an advantageous embodiment shown in the appended drawing. In the drawing FIG. 1 is a schematical partly sectional lateral elevational view of a carburettor assembly for an internal combustion engine installation in accordance with the present invention, and FIG. 2 is a schematical block diagram for illustrating the interconnections between this carburettor assembly and the controls of an engine installation with change-over switch operation.

Referring to FIG. 1, there is shown a carburettor of the so-called downdraft type. The carburettor includes an air intake tube 1 in which is arranged a throttle valve 2. The throttle valve 2 is adjustable in the conventional manner by an accelerator pedal 3 (FIG. 2), through a conventional connecting linkage 40. In FIG. 1, the throttle valve 2 is shown in its closed position. Below the throttle valve the air intake tube 1 is connected in the usual manner to a manifold (not shown) having branch-offs to the individual cylinders that are valve controlled. The float chamber 4 with the float 5 for controlling a predetermined fuel level 6 is arranged laterally of the intake tube 1. The float chamber 4 is connected at its bottom, by the main jet 11 and a connecting line or respectively a conduit 7, to a mixing tube or carburettor choke 8 at which may likewise be arranged a correction air jet 9. This conduit 7 is furthermore connected, by the branch conduit 10, to the intake tube 1 either through an exhaust port 41 or an exhaust tube 42 connected to this conduit.

The conduit 7 includes a branch conduit 12 that connects to a slow running jet system indicated generally by 13. As will be apparent, a special slow running bore 14 may supply air that mixes with the fuel supplied by the branch conduit 12. The downstream connected channel 15 leads to a slow running jet feed line 27 at the intake tube 1 downstream of the throttle valve 2. A cut-off valve 16 is provided in the vicinity of the connection between conduit 7 and float chamber 4. This cut-off valve 16 includes a valve body 17 adapted to be operated by a solenoid actuator 18 so as to either engage its seat 19 by spring force when it is intended to block the conduit 7, or to be lifted away from this seat when actuating the solenoid actuator 18. The parts 17, 18, 19 constitute a valve means. A spring is indicated e.g. by 43.

Figure 2:
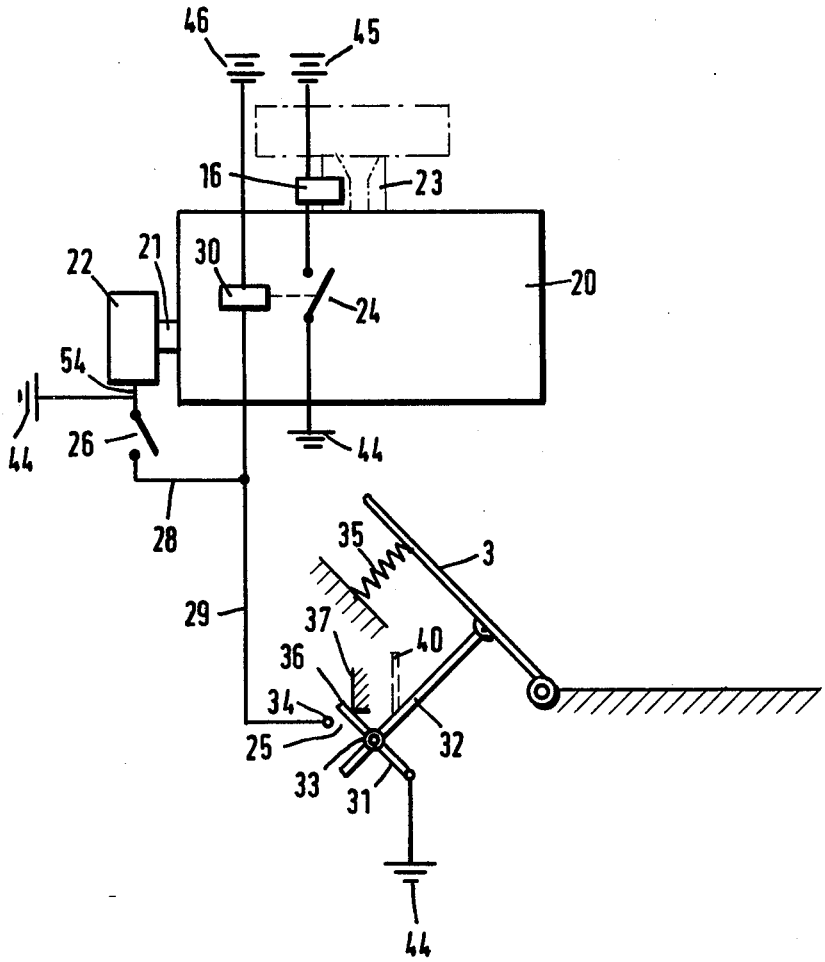

Referring to FIG. 2, there is shown schematically an internal combustion engine 20. A tachometer or rotary speed measuring device 22 is mounted e.g. on an output drive shaft 21. The carburettor together with the valve means 16 is indicated by 23 whereby a switch for switching on or off the valve means 16 is indicated by 24. It may be seen that a switch 25 is associated with the accelerator pedal 3, and a switch 26 is associated with the rotational speed measuring device 22. These switches are connected by leads 28, 29 to one side of the actuating means 30 for the switch 24, in order to actuate this switch under predetermined conditions. It will be apparent that either the switch 24 may establish a connection between ground 44 and a voltage source 45 through the valve means 16, or the switches 25 and 26 may connect the mass 44 to a voltage source 46 through the actuating means 30. By this, the corresponding members will be activated. The circuit is shown only schematically.

The switch shown generally by 25 includes an operating arm 31 that may e.g. be pivotably mounted on the actuating lever 32 of the accelerator pedal 3. A pivot movement will only be possible in overcoming a resistance. In the embodiment shown here, the operating arm 31 is mounted by a biased friction disc clutch 33. When actuating the accelerator pedal 3, the operating arm 31 engages the contact 34 of the switch 25, and upon further actuation, the operating arm will be shifted in the friction disc clutch in opposition to the friction effect so that the contact remains closed. When releasing the accelerator pedal 3, this pedal returns into its initial or rest position, under the action of the spring 35 whereby the switch 25 will open immediately. When returning to its initial position, a leg 36 of the operating arm 31 will engage a stationary abutment 37, in pivoting the operating arm 31 into its initial position shown.

The switch 26 that is coupled to the rotational speed measuring device 22 is controlled by this device, through functional coupling means 54, in a manner so that this switch will always remain closed within a range of minimum rotational speeds. This speed range may e.g. cover the range of from zero to 1,500 r.p.m.

The arrangement shown allows to block in pushing engine operation at rotational speeds above the indicated speed range, at least the main jet 11 and optionally likewise a slow running or auxiliary jet, i.e. virtually the whole carburettor.

In FIG. 1 is furthermore shown a diaphragm 47 in the wall of the air intake tube 1, the diaphragm being disposed in front of a diaphragm chamber 48. A pressure sensor 49 in this chamber acts through functional coupling means 50 on a switch 51 to control actuating means 30 for the switch 24 (FIG. 2).

FIG. 1 furthermore shows the fuel supply pipe 52 connected to the float chamber 4, as well as the float needle valve 53 that is controlled by the float 5.

What is claimed is:

1. A carburettor assembly in an internal combustion engine with a carburettor and at least one main jet, and an accelerator lever the carburettor including an inflow control chamber with an inflow control valve for adjusting a predetermined fuel supply within the inflow control chamber, the carburettor being in communication with an exhaust port through said main jet, valve means for controlling fuel flow to said jet in dependence upon the rotational speed of the engine, the improvement comprising a connecting line intermediate said inflow control chamber (4) and the carburettor said valve means arranged in said connecting line, means for blocking said main jet responsive to the rotational speed of the engine and a contact switch associated with said accelerator lever, said contact switch being adapted to be actuated in response to a backwardly directed movement of said lever to block said main jet (11) whereby said contact switch (25) controls actuating means of said valve means.

2. A carburettor assembly as defined in claim 1, said assembly further including a slow running jet (27) whereby said valve means (17–19) is arranged upstream of a branch conduit (12) connected to an optional slow running jet, and said slow running jet is likewise adapted to be blocked.

3. A carburettor assembly as defined in claim 1, wherein a switch actuating lever (31) of said contact switch is mounted by a biased friction disc clutch (33) and is adapted to be moved, after engaging a contact (34), in a direction opposing the frictional effects, is immediately disengageable upon releasing the accelerator lever, and returnable into its initial position at an abutment (37).

4. A carburettor assembly as defined in claim 1, further including a rotational speed measuring device (22) actuating in response to the rotational speed of said internal combustion engine, and being associated with blocking means (26) actuated thereby, said blocking means comprises a switch means (26) adapted to control the unblocking of said main jet (11) by actuating said valve means (17–19).

5. A carburettor assembly as defined in claim 4, wherein said switch means of said rotational speed measuring device is adjusted for a rotational speed in the range of from 1,000 to 1,500 r.p.m., and said valve means is open at speeds below said selected speed.

6. A carburettor assembly as defined in claim 1, wherein said inflow control chamber comprises a float chamber with a float.

* * * * *